US010885848B2

(12) United States Patent
Wu et al.

(10) Patent No.: US 10,885,848 B2
(45) Date of Patent: Jan. 5, 2021

(54) PIXEL DRIVING CIRCUIT, DRIVING METHOD THEREOF, AND ELECTRONIC DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Hailong Wu, Beijing (CN); Xiuzhu Tang, Beijing (CN); Taoliang Tang, Beijing (CN); Shuai Chen, Beijing (CN); Xing Dong, Beijing (CN); Lijun Xiong, Beijing (CN); Zhenguo Tian, Beijing (CN); Qiyuan Wei, Beijing (CN); Shuang Hu, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/530,963

(22) Filed: Aug. 2, 2019

(65) Prior Publication Data

US 2020/0286430 A1 Sep. 10, 2020

(30) Foreign Application Priority Data

Mar. 8, 2019 (CN) ..... 2019 1 0176459

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3291; G09G 3/3266; G09G 2300/0809;
(Continued)

(56) References Cited

U.S. PATENT DOCUMENTS 7,825,879 B2 11/2010 Yamashita et al.
8,933,920 B2 1/2015 Saito et al.
(Continued)

FOREIGN PATENT DOCUMENTS

CN 101986378 A * 3/2011
CN 101986378 A 3/2011
(Continued)

OTHER PUBLICATIONS

First Chinese Office Action dated Apr. 26, 2020, received for corresponding Chinese Application No. 201910176459.X, 19 pages.
(Continued)

*Primary Examiner* — Mark W Regn
(74) *Attorney, Agent, or Firm* — Kinney & Lange, P.A.

(57) ABSTRACT

Embodiments of the present disclosure provide a pixel driving circuit, a driving method thereof, and a display device. The pixel driving circuit comprises: a light emitting element and a driving transistor, a gate of the driving transistor being electrically coupled to a second node, a drain of the driving transistor being electrically coupled to a first node, and a source of the driving transistor being electrically coupled to the light emitting element; a first controlling circuit electrically coupled to the second node; a second controlling circuit electrically coupled to the first node and the second node; a third controlling circuit elec-
(Continued)

trically coupled to a first voltage signal terminal and the first node; a first energy storing circuit electrically coupled to the second node and a third node; a first adjusting circuit electrically coupled to the third node, a fourth node and a second voltage signal terminal.

14 Claims, 9 Drawing Sheets

(51) Int. Cl.
*G09G 3/3266* (2016.01)
*G09G 3/3291* (2016.01)

(52) U.S. Cl.
CPC ..... *G09G 3/3291* (2013.01); *G09G 2300/043* (2013.01); *G09G 2300/0426* (2013.01); *G09G 2300/0439* (2013.01); *G09G 2300/0809* (2013.01)

(58) Field of Classification Search
CPC ..... G09G 2300/0439; G09G 2300/043; G09G 2300/0426
See application file for complete search history.

(56) References Cited

U.S. PATENT DOCUMENTS

| | | | | |
|---|---|---|---|---|
| 9,153,173 | B2 | 10/2015 | Chang et al. | |
| 10,019,943 | B2 | 7/2018 | Wu | |
| 10,546,535 | B2 | 1/2020 | Dong | |
| 2005/0259051 | A1 | 11/2005 | Lee et al. | |
| 2006/0170628 | A1* | 8/2006 | Yamashita | G09G 3/3266 345/76 |
| 2013/0063041 | A1 | 3/2013 | Kimura | |
| 2018/0033365 | A1 | 2/2018 | Zhang et al. | |

FOREIGN PATENT DOCUMENTS

| | | | |
|---|---|---|---|
| CN | 203288217 | U | 11/2013 |
| CN | 103745690 | A | 4/2014 |
| CN | 105096819 | A | 11/2015 |
| CN | 105528992 | A | 4/2016 |
| CN | 205282056 | U | 6/2016 |
| CN | 106652904 | A | 5/2017 |
| CN | 108877684 | A | 11/2018 |
| KR | 20050110961 | A1 | 11/2005 |
| WO | 2010035672 | A1 | 4/2010 |

OTHER PUBLICATIONS

Zhou Lei, Pixel Circuit Design of OLED, A dissertation Submitted for the Degree of Master, 115 pages, Guangzhou, China.
Yan Li-Min, Long Yun-Teng, Guo Li-Yuan, A Novel OLED Pixel Compensation Driving Circuit, 19 pages, Microelectronic Research & Development Center, Shanghai University, Shanghai, China.

* cited by examiner

PIXEL DRIVING CIRCUIT, DRIVING METHOD THEREOF, AND ELECTRONIC DEVICE

CROSS-REFERENCE TO RELATED APPLICATION(S)

This application claims priority to Chinese Patent Application No. 201910176459.X filed on Mar. 8, 2019, the entire contents of which are hereby incorporated by reference.

TECHNICAL FIELD

The embodiments of the present disclosure relate to the field of display, and in particular to a pixel driving circuit, a driving method thereof, and an electronic device.

BACKGROUND

Active-matrix OLED (AMOLED) display panels have been widely used in various electronic devices due to advantages such as a low driving current, a long lifetime light emitting device and the like.

AMOLED display panels may use a pixel driving circuit with a 2T1C configuration (in particular, two transistors and one capacitor).

SUMMARY

Embodiments of the present disclosure provide a pixel driving circuit and a driving method thereof and a display device.

According to an aspect of the embodiments of the disclosure, there is provided a pixel driving circuit configured to drive a light emitting element to emit light, the pixel driving circuit comprising:

a driving transistor, a drain of the driving transistor being electrically coupled to a first node, a gate of the driving transistor being electrically coupled to a second node, and a source of the driving transistor being electrically coupled to a first terminal of the light emitting element;

a first controlling circuit electrically coupled to the second node and a data signal terminal, and configured to receive a first scanning signal, and output a signal of the data signal terminal to the second node under a control of the first scanning signal;

a second controlling circuit electrically coupled to the first node and the second node, and configured to receive a second scanning signal, and control an electrical connection between the first node and the second node by the second scanning signal;

a third controlling circuit electrically coupled to a first voltage signal terminal and the first node, and configured to receive a third scanning signal, and control the electrical connection between the first voltage signal terminal and the first node by the third scanning signal;

a first energy storing circuit electrically coupled to the second node and a third node; and a first adjusting circuit electrically coupled to the third node, a fourth node, a second voltage signal terminal and the data signal terminal, and configured to receive a fourth scanning signal, output the signal form the data signal terminal to the third node under a control of the fourth scanning signal, receive a fifth scanning signal and a sixth scanning signal, and output a second voltage signal form the second voltage signal terminal to the third node and the fourth node under a control of the fifth scanning signal and sixth scanning signal respectively.

For example, the first adjusting circuit comprises: a first adjusting sub-circuit electrically coupled to the third node and the data signal terminal, and configured to receive the fourth scanning signal, and output the signal of the data signal terminal to the third node, under the control of the fourth scanning signal; a second adjusting sub-circuit electrically coupled to the third node and the fourth node, and configured to receive the fifth scanning signal, and control the electrical connection between the third node and the fourth node by the fifth scanning signal; and a third adjusting sub-circuit electrically coupled to the fourth node and the second voltage signal terminal, and configured to receive the sixth scanning signal, and control the electrical connection between the fourth node and the second voltage signal terminal by the sixth scanning signal.

For another example, the first controlling circuit comprises a first transistor, a gate of the first transistor being electrically coupled to receive the first scanning signal, a first electrode of the first transistor being electrically coupled to the data signal terminal, and the second electrode of the first transistor being electrically coupled to the second node; the second controlling circuit comprises a second transistor, a gate of the second transistor being electrically coupled to receive the second scanning signal, a first electrode of the second transistor being electrically coupled to the second node, and a second electrode of the second transistor being electrically coupled to the first node; the third controlling circuit comprises a third transistor, a gate of the third transistor being electrically coupled to receive the third scanning signal, a first electrode of the third transistor being electrically coupled to the first voltage signal terminal, and the second electrode of the third transistor being electrically coupled to the first node; and the first energy storing circuit comprises a first capacitor, a first terminal of the first capacitor being electrically coupled to the second node, and a second terminal of the first capacitor being electrically coupled to the third node.

For another example, the first adjusting sub-circuit comprises a fourth transistor, a gate of the fourth transistor being electrically coupled to receive the fourth scanning signal, a first electrode of the fourth transistor being electrically coupled to the data signal terminal, and a second electrode of the fourth transistor being electrically coupled to the third node; the second adjusting sub-circuit comprises a fifth transistor, a gate of the fifth transistor being electrically coupled to receive the fifth scanning signal, a first electrode of the fifth transistor being electrically coupled to the third node, and a second electrode of the fifth transistor being electrically coupled to the fourth node; and the third adjusting sub-circuit comprises a sixth transistor, a gate of the sixth transistor being electrically coupled to receive the sixth scanning signal, a first electrode of the sixth transistor being electrically coupled to the fourth node, and the second electrode of the sixth transistor being electrically coupled to the second voltage signal terminal.

For another example, the pixel driving circuit further comprises: a second energy storing circuit electrically coupled to the third node and a fifth node; and a second adjusting circuit electrically coupled to the data signal terminal, the fifth node and the second voltage signal terminal, and configured to receive a seventh scanning signal, output the signal of the data signal terminal to the fifth node under a control of the seventh scanning signal, receive an eighth scanning signal, and output the second voltage signal to the fifth node under a control of the eighth scanning signal.

For another example, the second energy storing circuit comprises a second capacitor, a first terminal of the second capacitor being electrically coupled to the third node, and a second terminal of the second capacitor being electrically coupled to the fifth node; and the second adjusting circuit comprises a seventh transistor and an eighth transistor, a gate of the seventh transistor being electrically coupled to receive the seventh scanning signal, a first electrode of the seventh transistor being electrically coupled to the data signal terminal, and a second eletrode of the seventh transistor being electrically coupled to the fifth node; and a gate of the eighth transistor being electrically coupled to receive the eighth scanning signal, a first electrode of the eighth transistor being electrically coupled to the fifth node, and a second electrode of the eighth transistor being electrically coupled to the second voltage signal terminal.

According to another aspect of the embodiments of the present disclosure, there is provided a method of driving the pixel driving circuit in accordance with the above embodiments of the present disclosure, comprising:

during a first phase, writing the signal of the data signal terminal to the first energy storing circuit under the control of the first scanning signal, and outputting the second voltage signal to the third node and the fourth node for resetting, under the control of the fifth scanning signal and the sixth scanning signal;

during a second phase, discharging, by the first energy storing circuit, the second node, under the control of the second scanning signal, the fifth scanning signal and the sixth scanning signal, so as to enable the second node being at a first voltage;

during a third phase, outputting the signal of the data signal terminal at the first voltage to the third node under the control of the third scanning signal and the fourth scanning signal, and adjusting, by the first energy storing circuit, a voltage at the second node from the first voltage to a second voltage; and during a fourth phase, driving, by the driving transistor, the light emitting element to emit light under the control of the third scanning signal and the fifth scanning signal.

For example, the pixel driving circuit further comprises: a second energy storing circuit electrically coupled to the third node and a fifth node; and a second adjusting circuit electrically coupled to the fifth node and the second voltage signal terminal, and configured to receive the seventh scanning signal and a data signal, output the data signal to the fifth node under a control of the seventh scanning signal, the method further comprising:

during a fifth phase which is after the third phase but before the fourth phase, outputting the signal of the data signal terminal at the second voltage to the fifth node under the control of the seventh scanning signal, and adjusting the voltage at the second node from the second voltage to a third voltage by the first energy storing circuit and the second energy storing circuit.

For another example, during the first phase, the second phase and the third phase, the second voltage signal from the second voltage signal terminal is outputted to the fourth node under the control of the sixth scanning signal.

According to yet another aspect of the embodiments of the disclosure, there is provided a display device comprising the pixel driving circuit in accordance with the above embodiments of the present disclosure.

BRIEF DESCRIPTION OF THE DRAWINGS

In order to illustrate the technical solutions of the embodiments of the present disclosure more clearly, drawings used in the description of the embodiments will be briefly described below. Obviously, the drawings in the following description are only some of the embodiments of the present disclosure, and those skilled in the art can obtain other drawings according to these drawings with no effort.

DETAILED DESCRIPTION

The technical solutions of the embodiments of the present disclosure will be clearly and completely described hereinafter with reference to the accompanying drawings. It is apparent that the described embodiments are only a part of the embodiments of the disclosure, and not all of the embodiments. Other embodiments which may be obtained by those skilled in the art based on the embodiments of the present disclosure without departing from the inventive scope should all fall into the scope of the embodiments of the present disclosure.

Unless otherwise defined, technical terms or scientific terms used in the embodiments of the present disclosure should be understood in the ordinary meaning by those skilled in the art to which the embodiments of the disclosure belong. The words "first", "second" and similar terms used in the embodiments of the present disclosure do not denote any order, quantity, or importance, but are merely used to distinguish different components. The word "comprising" or "comprises" or the like means that the element or item preceding the word is intended to include the elements or items following the word and their equivalents, but do not exclude other elements or items, The words "connection" or "coupling" and the like are not limited to physical or mechanical connections, but may include electrical connections, whether direct or indirect. "Upper", "lower", "left", "right", etc. are only used to indicate the relative positional relationship. When an object to be described changes its absolute position, the relative positional relationship may also be changed accordingly.

Figure 1A:
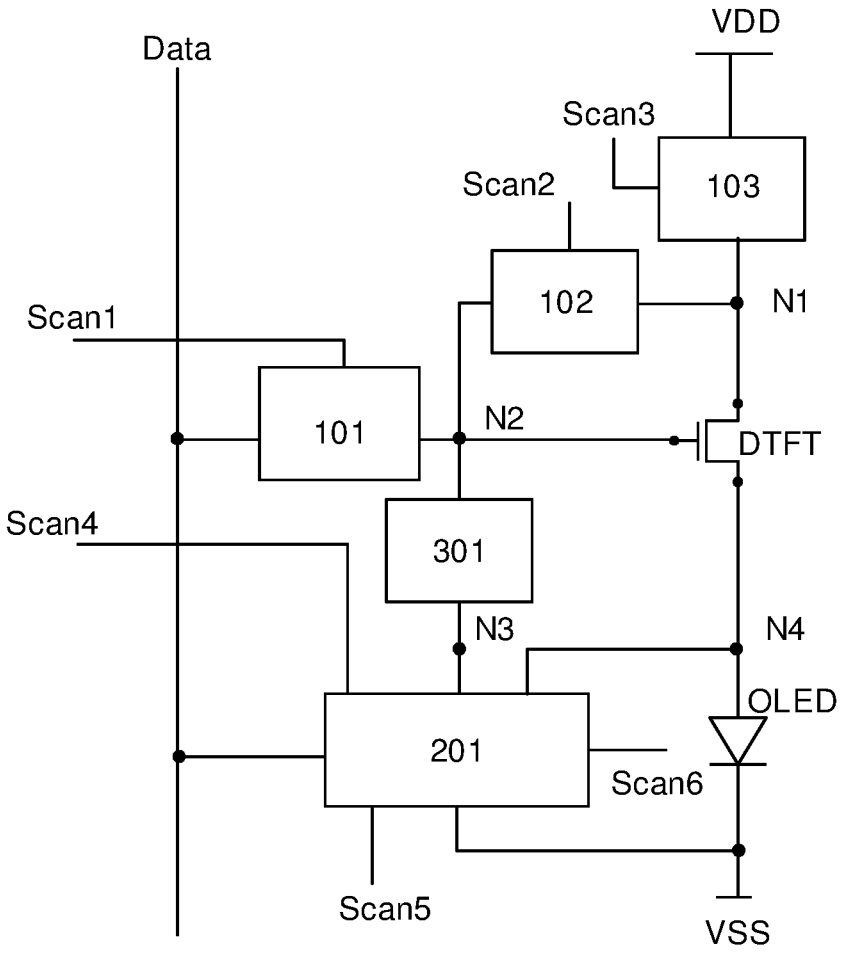
FIG. 1A shows a schematic structural diagram illustrating a pixel driving circuit according to an embodiment of the present disclosure.

Embodiments of the present disclosure provide a pixel driving circuit. FIG. 1A shows a schematic structural diagram illustrating a pixel driving circuit according to an embodiment of the present disclosure. As shown in FIG. 1A, the pixel driving circuit is configured to drive a light emitting element such as an organic light emitting diode OLED to emit light. Hereinafter, the description will be made by taking a light emitting element being the OLED as an example. Those skilled in the art can understand that the light emitting element can also be other current-driven light emitting elements. A first terminal of the organic light emitting diode OLED is coupled to a driving transistor DTFT, a gate of the driving transistor DTFT being electrically coupled to a second node N2, a drain of the driving transistor DTFT being electrically coupled to a first node N1, and a source of the driving transistor DTFT being electrically coupled to a fourth node N4.

As shown in FIG. 1A, the pixel driving circuit may further include: a first controlling circuit 101, a second controlling circuit 102, a third controlling circuit 103, a first adjusting circuit 201, and a first energy storing circuit 301.

The first controlling circuit 101 is electrically coupled to the second node N2 and a data signal terminal Data, and configured to receive a first scanning signal Scan1, and output a signal of the data signal terminal Data to the second node N2 under a control of the first scanning signal Scan1.

The second controlling circuit 102 is electrically coupled to the first node N1 and the second node N2, and configured to receive a second scanning signal Scan2, and control an electrical connection between the first node N1 and the second node N2 by the second scanning signal Scan2.

The third controlling circuit 103 is electrically coupled to a first voltage signal terminal VDD and the first node N1, and configured to receive a third scanning signal Scan3, and control the electrical connection between the first voltage signal terminal VDD and the first node N1 by the third scanning signal Scan3.

The first energy storing circuit 301 is electrically coupled to the second node N2 and a third node N3.

The first adjusting circuit 201 is electrically coupled to the third node N3, a fourth node N4, the data signal terminal Data, and a second voltage signal terminal.

It should be noted that the second voltage signal terminal may be the same voltage terminal as a power supply voltage terminal VSS coupled to a second terminal of the organic light emitting diode OLED, or may be a fixed voltage terminal independent from the power supply voltage terminal VSS, for example, a grounded terminal. The setting of the second voltage signal terminal is not limited herein, and may be selected as needed in practice.

For example, the first terminal of the organic light emitting diode OLED is an anode, and the second terminal of the organic light emitting diode OLED is a cathode. The voltage ($V_{vDD}$) of the first voltage signal terminal VDD is greater than the voltage ($V_{VSS}$) of the second voltage signal terminal VSS. Certainly, in the case where the second voltage signal terminal is the fixed voltage terminal provided independently, it is necessary to ensure that the voltage of the second voltage signal terminal is smaller than the voltage of the first voltage signal terminal VDD. The following embodiments are illustrated by taking the second voltage signal terminal and the power supply voltage terminal VSS being the same voltage terminal as an example.

Further, the first adjusting circuit 201 is configured to receive a fifth scanning signal Scan5 and a sixth scanning signal Scan6, and output a second voltage signal (the power supply voltage VSS) to the third node N3 and the fourth node N4 for resetting, under a control of the fifth scanning signal Scan5 and sixth scanning signal Scan6 respectively.

The pixel driving circuit controls the voltage at the second node N2 to reach a first voltage $V_1$ through the second controlling circuit 102, the third controlling circuit 103, the first adjusting circuit 201, and the first energy storing circuit 301. The first voltage $V_1$ is equal to a current threshold voltage $V_{th}$ of the driving transistor DTFT, i.e., $V_1=V_{th}$.

The first adjusting circuit 201 is further configured to receive a fourth scanning signal Scan4, and output the first data voltage $V_{data1}$ of the data signal terminal Data to the third node N3 under the control of the fourth scanning signal Scan4, so as to adjust the voltage at the second node N2 from the first voltage $V_1$ to a second voltage $V_2$ by the first energy storing circuit 301. The second voltage $V_2$ is equal to a sum of the first voltage $V_1$ and the first data voltage $V_{data1}$, i.e., $V_2=V_1+V_{data1}$.

Under the control of the first adjusting circuit 201, the third controlling circuit 103, and the first energy storing circuit 301, the second voltage $V_2$ at the second node N2 is outputted to the gate of the driving transistor DTFT, thereby driving the organic light emitting diode OLED to emit light.

Since the second voltage $V_2$ is equal to the sum of the first voltage $V_1$ and the first data voltage $V_{data1}$ (i.e. $V_2=V_1+V_{data1}$) and the first voltage $V_1$ is equal to the current threshold voltage $V_{th}$ of the driving transistor DTFT (i.e. $V_1=V_{th}$), it is known that the second voltage $V_2$ is equal to the sum of the current threshold voltage $V_{th}$ of the driving transistor DTFT and the first data voltage $V_{data1}$ (i.e. $V_2=V_{th}\pm V_{data1}$). Therefore, when the second voltage $V_2$ of the second node is output to the gate of the driving transistor DTFT, so as to control the current to flow through the organic light emitting diode for emitting light with a corresponding brightness, it is possible to enable the organic light emitting diode to emit light with a corresponding brightness ($V_{data1}$), meanwhile compensating (offsetting) the current threshold voltage of the driving transistor by the second voltage, thereby avoiding the problem of uneven brightness of the display due to a drift of the threshold voltage of the driving transistor.

Figure 1B:
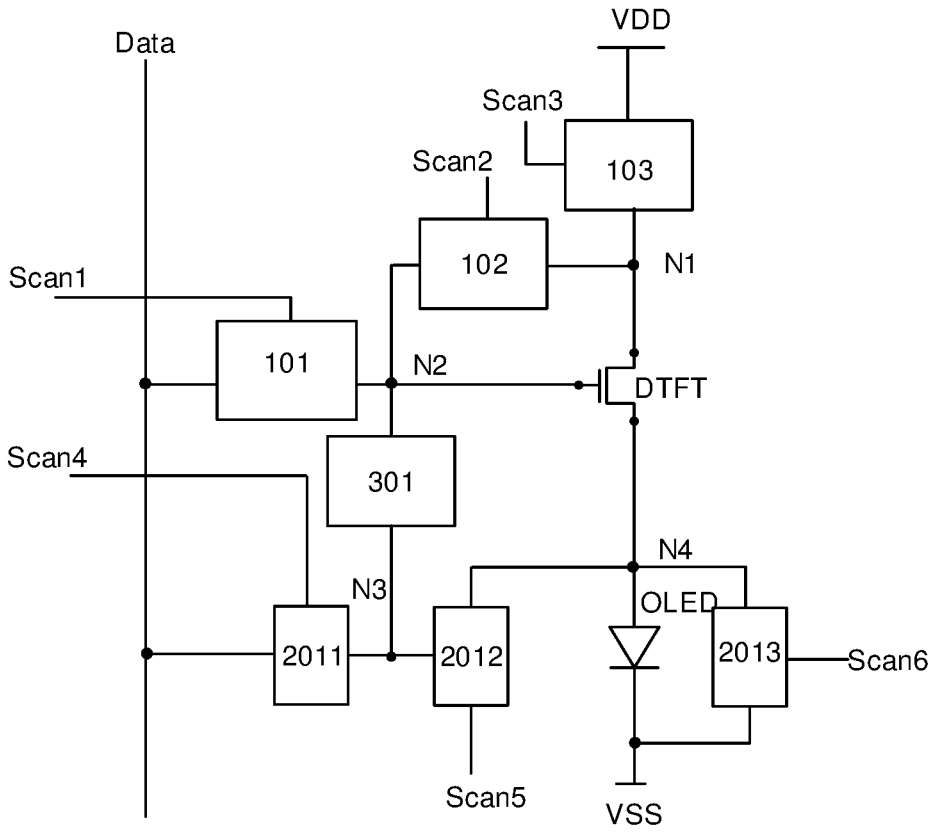
FIG. 1B shows a schematic structural diagram illustrating the pixel driving circuit according to an embodiment of the present disclosure.

FIG. 1B shows a schematic structural diagram illustrating the pixel driving circuit according to an embodiment of the present disclosure. As shown in FIG. 1B, the first adjusting circuit 201 may include a first adjusting sub-circuit 2011, a second adjusting sub-circuit 2012 and a third adjusting sub-circuit 2013.

The first adjusting sub-circuit 2011 is electrically coupled to the data signal terminal Data and the third node N3 and configured to receive the fourth scanning signal Scan4, and output the signal of the data signal terminal Data to the third node N3, under the control of the fourth scanning signal Scan4.

The second adjusting sub-circuit 2012 is electrically coupled to the third node N3 and the fourth node N4, and configured to receive the fifth scanning signal Scan5, and control the electrical connection between the third node N3 and the fourth node N4 by the fifth scanning signal Scan5.

The third adjusting sub-circuit 2013 is electrically coupled to the fourth node N4 and the second voltage signal terminal (for example, VSS), and configured to receive the sixth scanning signal Scan6, and control the electrical connection between the fourth node N4 and the second voltage signal terminal by the sixth scanning signal Scan6.

In this case, the first adjusting circuit 201 may reset the third node N3 and the fourth node N4 with the voltage at the second voltage signal terminal (for example, VSS), under the control of the fifth scanning signal Scan5 and the sixth scanning signal Scan6. The resetting can be implemented by the second adjusting sub-circuit 2012 in the first adjusting circuit 201 under the control of the fifth scanning signal Scan5, and the third adjusting sub-circuit 2013 in the first adjusting circuit 201 under the control of the sixth scanning signal Scan6.

The first adjusting circuit 201 may output a signal of the data signal terminal Data to the third node N3 under the control of the fourth scanning signal Scan4, so as to adjust the voltage at the second node N2 from the first voltage $V_1$ to the second voltage $V_2$ through the first energy storing circuit 301. The adjustment can be implemented by the first adjusting sub-circuit 2011 in the first adjusting circuit 201 under the control of the fourth scanning signal Scan4.

Figure 1C:
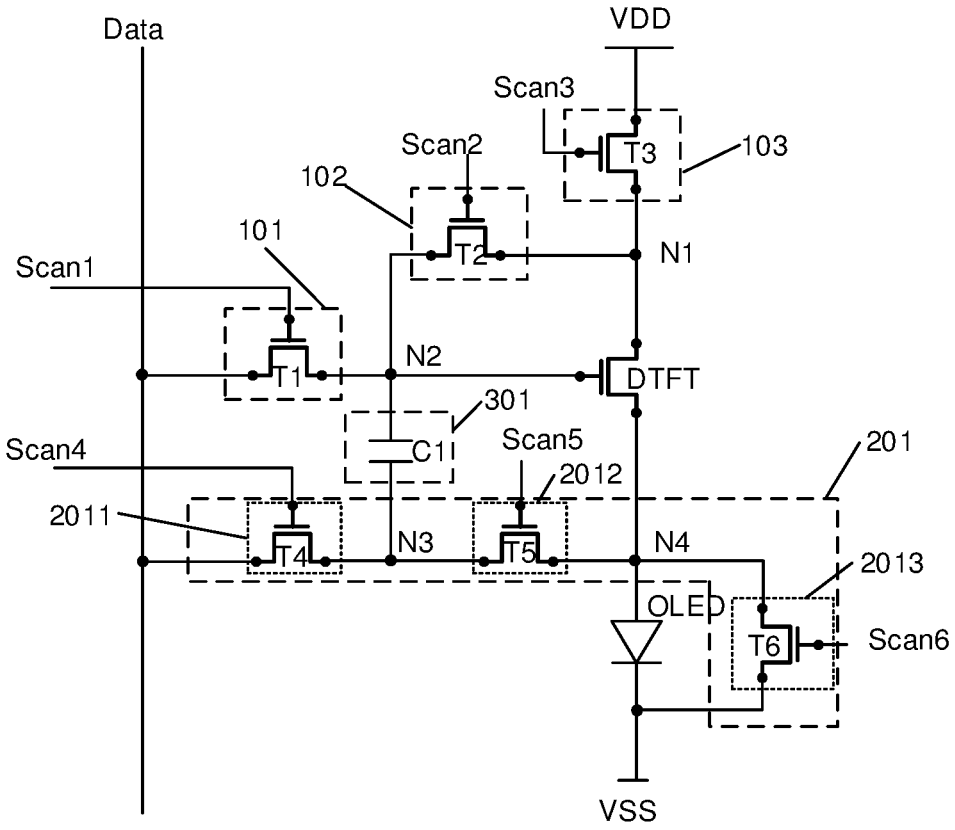
FIG. 1C shows a circuit diagram of the pixel driving circuit according to an embodiment of the present disclosure.

For example, specific circuit structures of each of the above circuits and sub-circuits will be further described below. FIG. 1C shows a circuit diagram of the pixel driving circuit according to an embodiment of the present disclosure. As shown in FIG. 1C, the first controlling circuit 101 may include a first transistor T1, a gate of the first transistor T1 being electrically coupled to receive the first scanning signal Scan1, a first electrode of the first transistor T1 being electrically coupled to the data signal terminal Data, and the second electrode of the first transistor T1 being electrically coupled to the second node N2.

As shown in FIG. 1C, the second controlling circuit 102 may include a second transistor T2, a gate of the second transistor T2 being electrically coupled to receive the second scanning signal Scan2, a first electrode of the second transistor T2 being electrically coupled to the second node N2, and a second electrode of the second transistor T2 being electrically coupled to the first node N1.

As shown in FIG. 1C, the third controlling circuit 103 may include a third transistor T3, a gate of the third transistor T3 being electrically coupled to receive the third scanning signal Scan3, a first electrode of the third transistor T3 being electrically coupled to the first voltage signal terminal VDD, and the second electrode of the third transistor being electrically coupled to the first node N1.

As shown in FIG. 1C, the first energy storing circuit 301 may include a first capacitor C1, a first terminal of the first capacitor C1 being electrically coupled to the second node N2, and a second terminal of the first capacitor C1 being electrically coupled to the third node N3.

As shown in FIG. 1C, the first adjusting sub-circuit 2011 may include a fourth transistor T4, a gate of the fourth transistor T4 being electrically coupled to receive the fourth scanning signal Scan4, a first electrode of the fourth transistor T4 being electrically coupled to the data signal terminal Data, and a second electrode of the fourth transistor T4 being electrically coupled to the third node N3.

As shown in FIG. 1C, the second adjusting circuit 2012 may include a fifth transistor T5, a gate of the fifth transistor T5 being electrically coupled to receive the fifth scanning signal Scan5, a first electrode of the fifth transistor T5 being electrically coupled to the third node N3, and a second electrode of the fifth transistor T5 being electrically coupled to the fourth node N4.

As shown in FIG. 1C, the third adjusting sub-circuit 2013 may include a sixth transistor T6, a gate of the sixth transistor T6 being electrically coupled to receive the sixth scanning signal Scan6, a first electrode of the sixth transistor T6 being electrically coupled to the fourth node N4, and the second electrode of the sixth transistor T6 being electrically coupled to the second voltage signal terminal VSS.

Taking the pixel driving circuit shown in FIG. 1C as an example, those skilled in the art can understand that during the light emitting phase of the light emitting element, the driving current $I_{OLED}$ flowing through the organic light emitting diode OLED is given by:

$$I_{OLED} = \frac{1}{2}\mu Cox\frac{W}{L}[V_2 - V_{VDD} - V_{th}] = \frac{1}{2}\mu Cox\frac{W}{L}[(V_{data1} + V_{th}) - V_{VDD} - V_{th}]^2 = \frac{1}{2}\mu Cox\frac{W}{L}[V_{data1} - V_{VDD}]^2$$

wherein μ is the carrier mobility, W is the width of the channel, L is the length of the channel, and Cox is the capacitance of the insulation layer per unit area.

It can be seen that the driving current $I_{OLED}$ flowing through the organic light emitting diode OLED is independent from the threshold voltage $V_{th}$ of the driving transistor DTFT, that is, the current threshold voltage $V_{th}$ of the driving transistor DTFT is compensated by using the pixel driving circuit according to an embodiment of the present disclosure, thereby avoiding the problem of uneven brightness of the display due to the drift of the threshold voltage of the driving transistor.

Figure 2A:
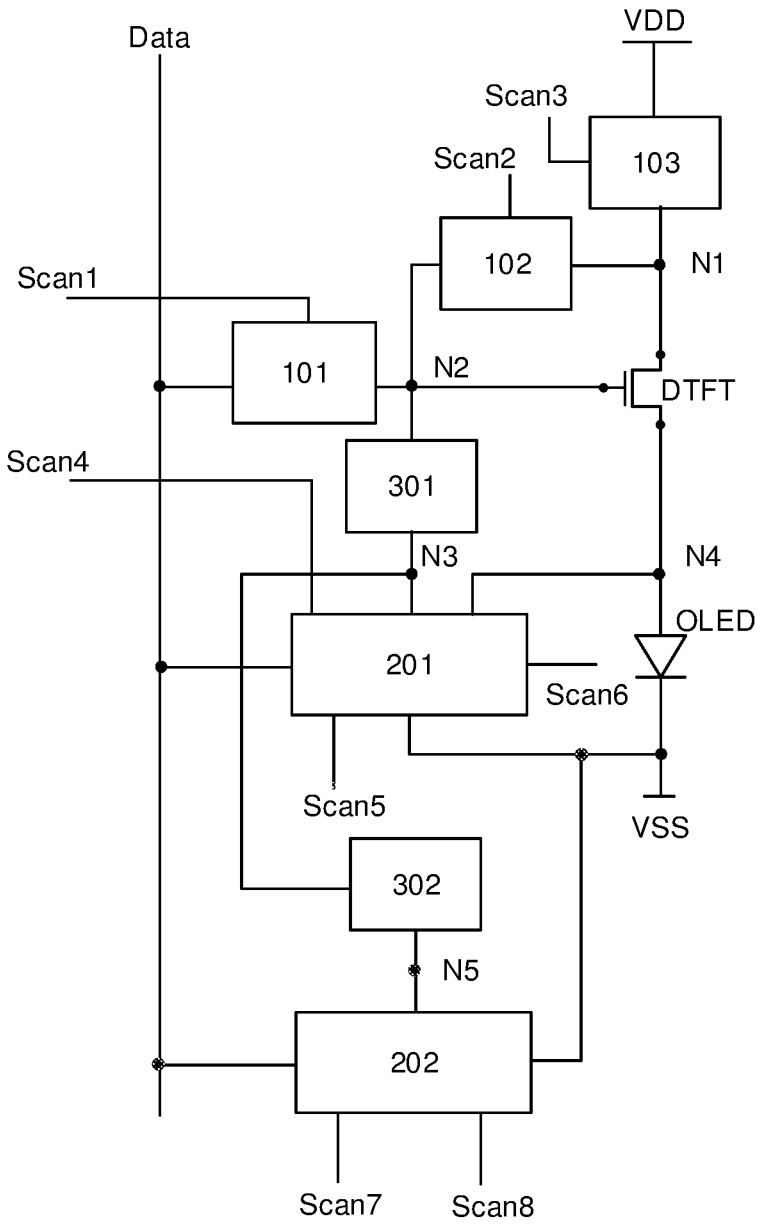
FIG. 2A shows a schematic structural diagram illustrating the pixel driving circuit according to another embodiment of the present disclosure.

The pixel driving circuit according to the embodiments of the present disclosure increases the driving current of the organic light emitting diode while compensating for the current threshold voltage of the driving transistor, thereby increasing display brightness. FIG. 2A shows a schematic structural diagram illustrating the pixel driving circuit according to another embodiment of the present disclosure. As shown in FIG. 2A, in some embodiments, the pixel driving circuit of the embodiment of the present disclosure may further include: a second energy storing circuit 302 and a second adjusting circuit 202.

The second energy storing circuit 302 is electrically coupled to the third node N3 and a fifth node N5.

The second adjusting circuit 202 is electrically coupled to the data signal terminal Data, the fifth node N5, and the second voltage signal terminal VSS.

The second adjusting circuit 202 is configured to receive the eighth scanning signal Scan8, and output the voltage of the second voltage terminal VSS to the fifth node N5 for resetting under the control of the eighth scanning signal Scan8.

The second adjusting circuit 202 further receives the seventh scanning signal Scan7, and outputs the signal of the data signal terminal Data to the fifth node N5 under the control of the seventh scanning signal Scan7, so as to adjust the voltage at the second node N2 from the second voltage $V_2$ to the third voltage $V_3$ through the second energy storing circuit 302 and the first energy storing circuit 301. Those skilled in the art will understand that the voltage of the data signal terminal Data may be a second data voltage $V_{data2}$. Therefore, the third voltage $V_3$ may be equal to a sum of the second voltage $V_2$ and the second data voltage $V_{data2}$, i.e., $V_3=V_2+V_{data2}$.

As discussed before, if $V_2=V_1+V_{data1}$ and $V_1=V_{th}$, $V_3=V_{th}+V_{data1}+V_{data2}$. At this time, during the light emitting phase of the light emitting element, the driving current flowing through the organic light-emitting diode OLED is given by:

$$I_{OLED} = \frac{1}{2}\mu Cox\frac{W}{L}[V_{data1} + V_{data2} - V_{VDD}]^2$$

wherein the first data voltage $V_{data1}$ and the second data voltage $V_{data2}$ may be equal or not equal. In practice, for convenience of control, the first data voltage $V_{data1}$ and the second data voltage $V_{data2}$ may be set equal (i.e., $V_{data1}=V_{data2}$), and the following embodiments are all described in view of this.

Compared with the pixel driving circuit in FIG. 1A to FIG. 1C discussed above $$\left(I_{OLED} = \frac{1}{2}\mu Cox\frac{W}{L}[V_{data1} - V_{VDD}]\right),$$

by providing the second energy storing circuit 302 and the second adjusting circuit 202, the pixel driving circuit may increase the current flowing through the organic light emitting diode OLED $$\left(I_{OLED} = \frac{1}{2}\mu Cox\frac{W}{L}[2V_{Data1} - V_{VDD}]\right),$$

thereby improving the brightness of the organic light emitting diode OLED. Certainly, in the case where the organic light emitting diode OLED emits light with the same brightness (requiring the same driving current), the first data voltage $V_{data1}$ can be correspondingly reduced, thereby reducing the power consumption for driving.

Figure 2B:
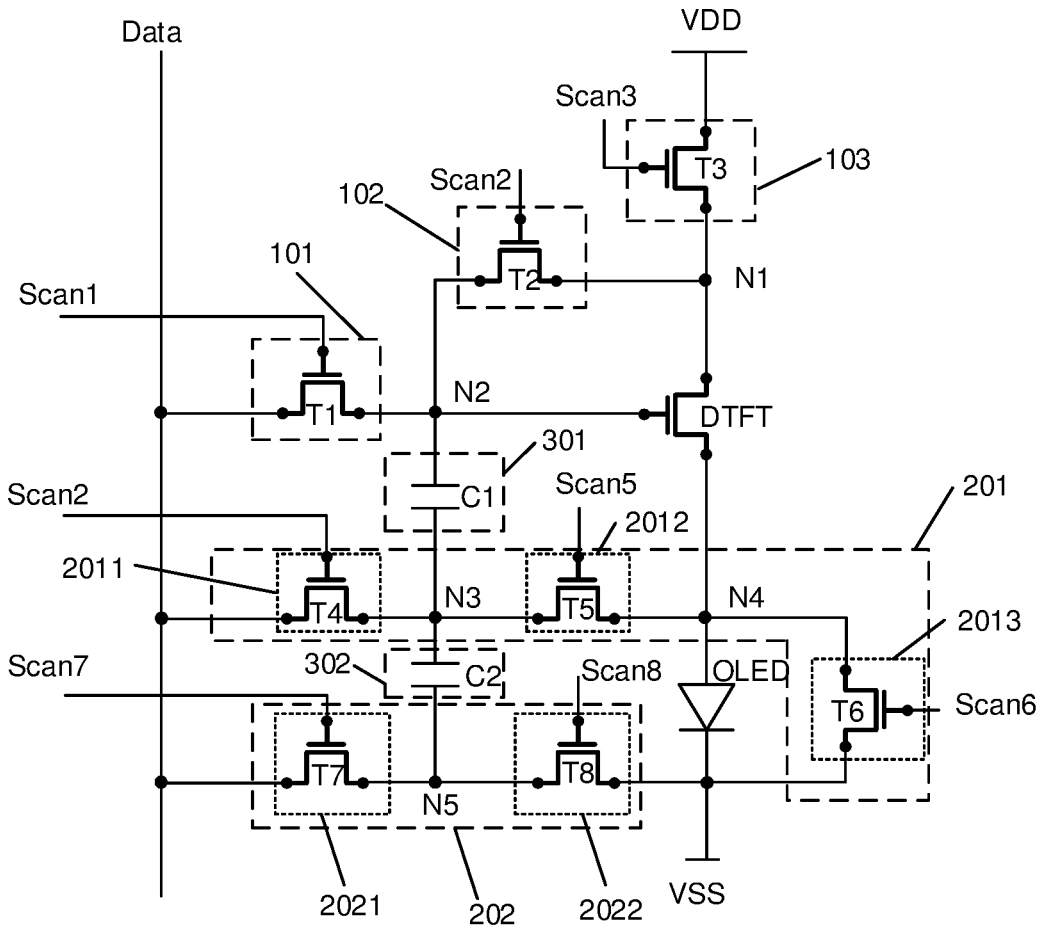
FIG. 2B shows a circuit diagram of the pixel driving circuit according to another embodiment of the present disclosure.

The specific structures of the second energy storing circuit 302 and the second adjusting circuit 202 described above will be further described below. FIG. 2B shows a circuit diagram of the pixel driving circuit according to another embodiment of the present disclosure As shown in FIG. 2B, the second energy storing circuit 302 may include a second capacitor C2, wherein a first terminal of the second capacitor C2 is coupled to the third node N3, and a second terminal of the second capacitor C2 is coupled to the fifth node N5.

For example, as shown in FIG. 2B, the second adjusting circuit 202 may include a seventh transistor T7 and an eighth transistor T8.

A gate of the seventh transistor T7 may receive the seventh scanning signal Scan7, a first electrode of the seventh transistor T7 is coupled to the data signal terminal Data, and a second electrode of the seventh transistor T7 is coupled to the fifth node N5.

A gate of the eighth transistor T8 may receive the eighth scanning signal Scan8, a first electrode of the eighth transistor T8 is coupled to the fifth node N5, and a second electrode of the eighth transistor T8 is coupled to the second voltage signal terminal VSS.

According to an embodiment of the present disclosure, the eighth transistor T8 resets the fifth node N5 by the voltage of the second voltage signal terminal VSS, under the control of the eighth scanning signal Scan8. The seventh transistor T7 outputs the second data voltage $V_{data\ 2}$ of the data signal terminal Data to the fifth node N5 under the control of the seventh scanning signal Scan7, so as to adjust the voltage at the second node N2 from the second voltage $V_2$ to the third voltage $V_3$ by the second energy storing circuit 302 and the first energy storing circuit 301.

It should be noted that the pixel driving circuit in the embodiment of the present disclosure may be applied to a constant current source circuit, and may also be applied to a source follower. The above transistors T1 to T8 which are used as switches may be N-type transistors or P-type transistors. Alternatively, they may be enhancement transistors or depletion transistors. Furthermore, they may be amorphous silicon thin film transistors, polysilicon thin film transistors or amorphous-indium gallium zinc oxide thin film transistors. In addition, the first electrode of each of the above transistors may be a source, and the second electrode of each of the above transistors may be a drain. Alternatively, the first electrode of each of the above transistors may be the drain, and the second electrode of each of the above transistors may be the source, which is not limited herein.

Figure 3:
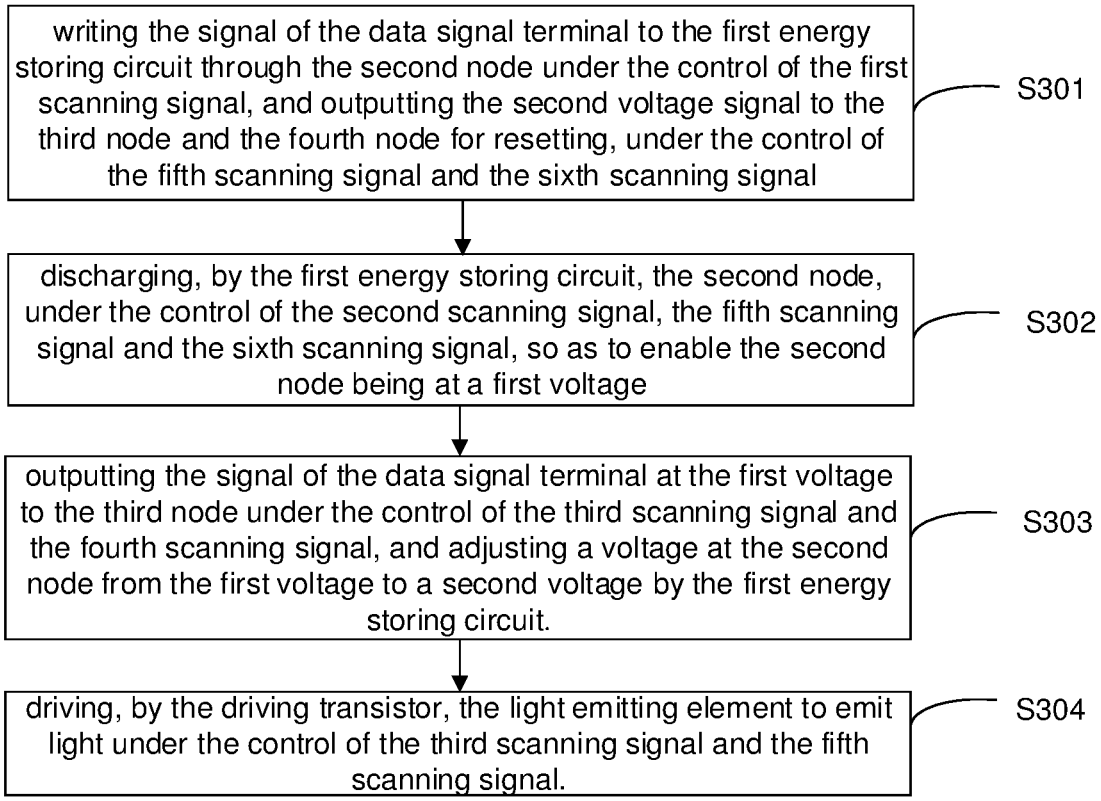
FIG. 3 shows a flow chart illustrating a driving method of the pixel driving circuit according to an embodiment of the present disclosure.

Embodiments of the present disclosure also provide a method for driving the pixel driving circuit according to the embodiment of the present disclosure. As shown in FIG. 3, the method may include the following steps.

In step S301, during a first phase, the signal of the data signal terminal is written to the first energy storing circuit under the control of the first scanning signal, and the second voltage signal is output to the third node and the fourth node for resetting, under the control of the fifth scanning signal and the sixth scanning signal.

In step S302, during a second phase, the first energy storing circuit discharges the second node, under the control of the second scanning signal, the fifth scanning signal and the sixth scanning signal, so as to enable the second node being at a first voltage.

In step S303, during a third phase, the signal of the data signal terminal at the first voltage is output to the third node under the control of the third scanning signal and the fourth scanning signal, and a voltage at the second node is adjusted from the first voltage to a second voltage by the first energy storing circuit.

In step S304, during a fourth phase, the light emitting element is driven by the driving transistor to emit light, under the control of the third scanning signal and the fifth scanning signal.

Figure 4:
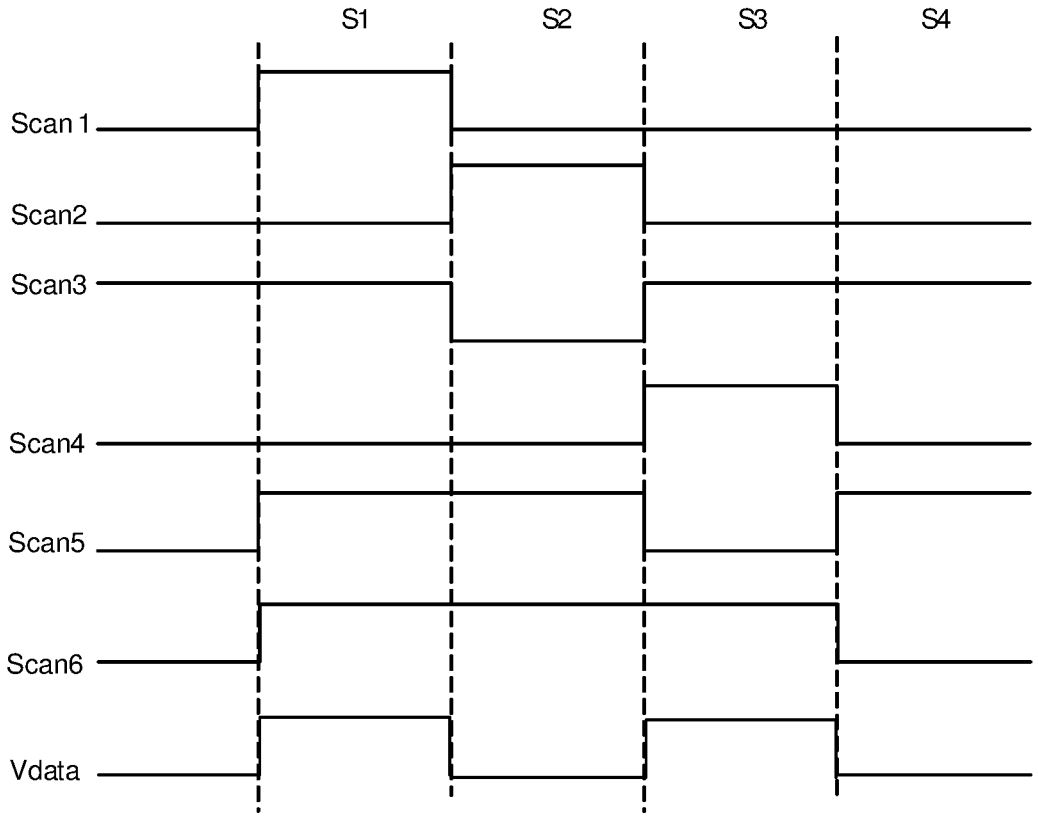
FIG. 4 shows a signal timing diagram of the pixel driving circuit according to an embodiment of the present disclosure.

FIG. 4 shows a signal timing diagram of the pixel driving circuit according to an embodiment of the present disclosure. The method for driving the pixel driving circuit according to an embodiment of the present disclosure will be described in detail below with reference to FIG. 1C, FIG. 3, and FIG. 4.

First, during the first phase, that is, the pre-charging phase S1, the first scanning signal Scant, the third scanning signal Scan3, the fifth scanning signal Scan5, and the sixth scanning signal Scan6 are, for example, active level signal of a high level. The voltage Vdata of the data signal terminal Data is written to the first energy storing circuit 301 through the second node N2, meanwhile the voltage (for example, at a low level) of the second voltage signal terminal VSS being output to the third node N3 and the fourth node N4, so as to reset the third node N3 and the fourth node N4. For example, the term "active level" refers to a level which enables a transistor being turned on when it is applied to the gate of the transistor. In the example where each transistor is an N-type transistor, the "active level" should be the high level.

For example, the first scanning signal Scant, the third scanning signal Scan3, the fifth scanning signal Scan5, and the sixth scanning signal Scan6 are high level signals. The first transistor T1, the fifth transistor T5, the sixth transistor T6 and the third transistor T3 are all turned on. The voltage Vdata of the data signal terminal Data is output to the second node N2 through the first transistor T1 and stored to the first capacitor C1. The second voltage signal VSS resets the third node N3 and the fourth node N4 through the fifth transistor T5 and the sixth transistor T6.

During the second phase, that is, the threshold voltage writing phase S2, the second scanning signal Scan2, the fifth scanning signal Scan5 and the sixth scanning signal Scan6 are high level signals. The first energy storing circuit 301 discharges the second node N2, and the voltage of the second node N2 reaches the first voltage $V_1$. The first voltage $V_1$ is equal to the current threshold voltage $V_{th}$ of the driving transistor DTFT, that is, $V_1=V_{th}$.

During the phase S2, the second scanning signal Scan2, the fifth scanning signal Scan5, and the sixth scanning signal Scan6 are high level signals. The fifth transistor T5, the sixth transistor T6 and the second transistor T2 are all turned on. In this case, the gate of the driving transistor DTFT is short-circuited with the drain. The voltage of the second node N2 (i.e., the aforementioned first voltage $V_1$) reaches the current threshold voltage $V_{th}$ of the driving transistor DTFT, since the first capacitor C1 is discharged.

During the third phase, that is, the pixel data writing phase S3, the third scanning signal Scan3, the fourth scanning signal Scan4, and the sixth scanning signal Scan6 are high level signals. Therefore, the first data voltage $V_{data1}$ of the data signal terminal Data is output to the third node N3, and the voltage at the second node N2 is adjusted from the first voltage $V_1$ to the second voltage $V_2$ by the first energy storing circuit 301, wherein the second voltage $V_2$ is equal to the sum of the first voltage $V_1$ and the first data voltage $V_{data1}$, i.e., $V_2=V_1+V_{data1}$.

During this phase S3, the third scanning signal Scan3 and the fourth scanning signal Scan4 are high level signals. The fourth transistor T4 and the third transistor T3 are turned on, and the data voltage $V_{data1}$ of the data signal terminal Data is output to the third node N3. The voltage at the second node N2 rises from the first voltage $V_1$ to the second voltage $V_2$ due to the bootstrap of the first capacitor C1, wherein the second voltage $V_2$ is equal to the sum of the first voltage $V_1$ and the first data voltage $V_{data1}$, that is, $V_2=V_1+V_{data}$. Since the first voltage $V_1$ is equal to the current threshold voltage $V_{th}$ of the driving transistor DTFT, i.e. $V_1=V_{th}$, the second voltage $V_2$ is equal to the sum of the current threshold voltage $V_{th}$ of the driving transistor DTFT and the first data voltage $V_{data1}$, that is, $V_2=V_{th}+V_{data1}$.

The sixth scanning signal Scan6 is a high level signal to ensure the fourth node N4 being in an initialization state, so as to enable a stable illumination of the organic light emitting diode during the next light emitting phase S4.

During the fourth phase, i.e., a light emitting phase S4, the third scanning signal Scan3 and the fifth scanning signal Scan5 are high level signals, and the organic light emitting diode OLED starts to emit light.

During the light emitting phase S4, the third scanning signal Scan3 and the fifth scanning signal Scan5 are high level signals, and the fifth transistor T5 and the third transistor T3 are turned on. The first capacitor C1 continuously discharges the second node N2 (i.e., the gate of the driving transistor DTFT), so as to control the current flowing through the source and drain of the driving transistor DTFT. Therefore, the organic light emitting diode OLED emits the light with a corresponding brightness under the driving of the current.

It can be understood that, in this case, the driving current $I_{OLED}$ flowing through the organic light emitting diode OLED is given by:

$$I_{OLED} = \frac{1}{2}\mu Cox\frac{W}{L}[V_{data1} - V_{VDD}]^2.$$

It can be seen that the driving current $I_{OLED}$ flowing through the organic light emitting diode OLED is independent of the threshold voltage $V_{th}$ of the driving transistor DTFT, thereby avoiding the problem of uneven brightness of the display due to a drift of the threshold voltage of the driving transistor.

Figure 5:
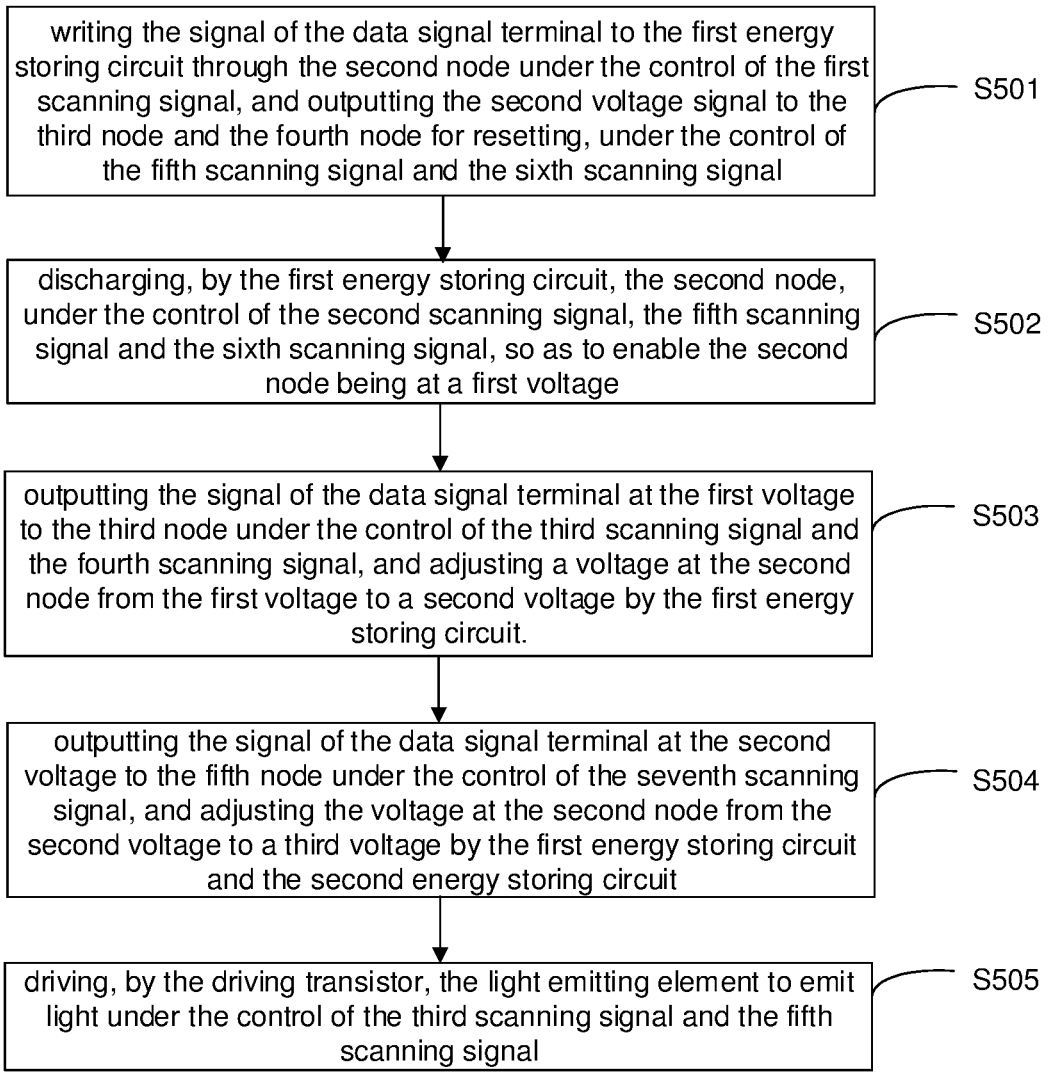
FIG. 5 shows a flow chart illustrating the driving method of the pixel driving circuit according to an embodiment of the present disclosure.

In some embodiments, the pixel driving circuit as shown in FIG. 2A and FIG. 2B further includes a second energy storing circuit 302 and a second adjusting circuit 202. FIG. 5 shows a flow chart illustrating the driving method of the pixel driving circuit according to an embodiment of the present disclosure. As shown in FIG. 5, the method for driving the pixel driving circuit includes:

in step S501, writing the signal of the data signal terminal to the first energy storing circuit through the second node under the control of the first scanning signal, and outputting the second voltage signal to the third node and the fourth node for resetting, under the control of the fifth scanning signal and the sixth scanning signal;

in step S502, discharging, by the first energy storing circuit, the second node, under the control of the second scanning signal, the fifth scanning signal and the sixth scanning signal, so as to enable the second node being at a first voltage;

in step S503, outputting the signal of the data signal terminal at the first voltage to the third node under the control of the third scanning signal and the fourth scanning signal, and adjusting, by the first energy storing circuit, a voltage at the second node from the first voltage to a second voltage;

in step S504, outputting the signal of the data signal terminal at the second voltage to the fifth node under the control of the seventh scanning signal, and adjusting the voltage at the second node from the second voltage to a third voltage by the first energy storing circuit and the second energy storing circuit; and in step S505, driving, by the driving transistor, the light emitting element to emit light under the control of the third scanning signal and the fifth scanning signal.

Next, the method for driving the pixel driving circuit according to another embodiment of the present disclosure will be described in detail with reference to FIG. 2A, FIG. 2B, FIG. 5, and FIG. 6. The first scanning signal Scan1, the third scanning signal Scan3, the fifth scanning signal Scan5, the sixth scanning signal Scan6, and the eighth scanning signal Scan8 are, for example, active level signals of a high level. The voltage Vdata of the data signal terminal Data is written to the first energy storing circuit 301 through the second nodes N2, meanwhile the second voltage signal VSS being output to the third node N3, the fourth node N4, and the fifth node N5 for resetting the third node N3, the fourth node N4, and the fifth node N5.

For example, the first scanning signal Scan1, the third scanning signal Scan3, the fifth scanning signal Scan5, the sixth scanning signal Scan6, and the eighth scanning signal Scan8 are high level signals. The first transistor T1, the fifth transistor T5, the sixth transistor T6, the third transistor T3 and the eighth transistor T8 are all turned on. The voltage Vdata of the data signal terminal Data is output to the second node N2 through the first transistor T1 and stored to the first capacitor C1. The second voltage signal VSS resets the third node N3, the fourth node N4, and the fifth node N5 through the fifth transistor T5, the sixth transistor T6, and the eighth transistor T8.

Next, during the phase S2, the second scanning signal Scan2, the fifth scanning signal Scan5, and the sixth scanning signal Scan6 are high level signals. The first energy storing circuit 301 discharges the second node N2, and the voltage at the second node reaches the first voltage $V_1$, wherein the first voltage $V_1$ is equal to the current threshold voltage $V_{th}$ of the driving transistor DTFT, that is, $V_1=V_{th}$.

For example, the second scanning signal Scan2, the fifth scanning signal Scan5, and the sixth scanning signal Scan6 are high level signals. The fifth transistor T5, the sixth transistor T6, and the second transistor T2 are all turned on. In this case, the gate of the driving transistor DTFT is short-circuited with the drain, and the first capacitor C1 is discharged until the voltage at the second node N2 is equal to the current threshold voltage $V_{th}$ of the driving transistor DTFT, i.e., the first voltage $V_1$ discussed above.

Next, during the phase S3, the third scanning signal Scan3, the fourth scanning signal Scan4, the sixth scanning signal Scan6, and the eighth scanning signal Scan8 are high level signals. The second voltage signal VSS is output to the fifth node N5. The data voltage of the data signal terminal Data, such as $V_{data1}$, is output to the third node N3, and the voltage at the second node N2 is adjusted from the first voltage $V_1$ to the second voltage $V_2$ through the first energy storing circuit 301, wherein the second voltage $V_2$ is equal to the sum of the first voltage $V_1$ and the first data voltage $V_{data1}$, i.e., $V_2=V_1+V_{data}$.

For example, the third scanning signal Scan3, the fourth scanning signal Scan4, the sixth scanning signal Scan6, and the eighth scanning signal Scan8 are high level signals. The fourth transistor T4, the third transistor T3 and the eighth transistor T8 are turned on. The second voltage signal VSS is output to the fifth node N5, so as to reset the fifth node N5. The first data voltage of the data signal terminal Data, for example, $V_{data1}$, is output to the third node N3. The voltage at the second node N2 rises from the first voltage $V_1$ to the second voltage $V_2$ due to the bootstrap of the first capacitor C1, wherein the second voltage $V_2$ is equal to the sum of the first voltage $V_1$ and the first data voltage $V_{data1}$, that is, $V_2=V_1+V_{data}$. Since the first voltage $V_1$ is equal to the current threshold voltage $V_{th}$ of the driving transistor DTFT, i.e. $V_1=V_{th}$, the second voltage $V_2$ is equal to the sum of the current threshold voltage $V_{th}$ of the driving transistor DTFT and the first data voltage $V_{data1}$, that is, $V_2=V_{th}+V_{data1}$.

Next, during the phase S3', the seventh scanning signal Scan7 is a high level signal, and the second data voltage $V_{data2}$ of the data signal terminal Data is output to the fifth node N5. The voltage at the second node N2 is adjusted from the second voltage $V_2$ to the third voltage $V_3$ through the first energy storing circuit 301 and the second energy storing circuit 302, wherein the third voltage $V_3$ is equal to the sum of the second voltage $V_2$ and the second data voltage $V_{data2}$.

Specifically, during this phase S3', the seventh scanning signal Scan7 is a high level signal, and the seventh transistor T7 is turned on. The second data voltage $V_{data2}$ of the data signal terminal Data is output to the fifth node N5. The voltage at the second node N2 rises from the second voltage $V_2$ to the third voltage $V_3$ due to the bootstrap of the second capacitor C2 and the first capacitor C1. At this time, the third voltage $V_3$ is equal to the sum of the second voltage $V_2$ and the second data voltage $V_{data2}$. Since $V_2=V_1+V_{data}$, and $V_1=V_{th}$, $V_3=V_{th}+V_{data1}+V_{data2}$. Further, if $V_{data1}=V_{data2}$, $V_3=V_{th}+2V_{data1}$.

Figure 6:
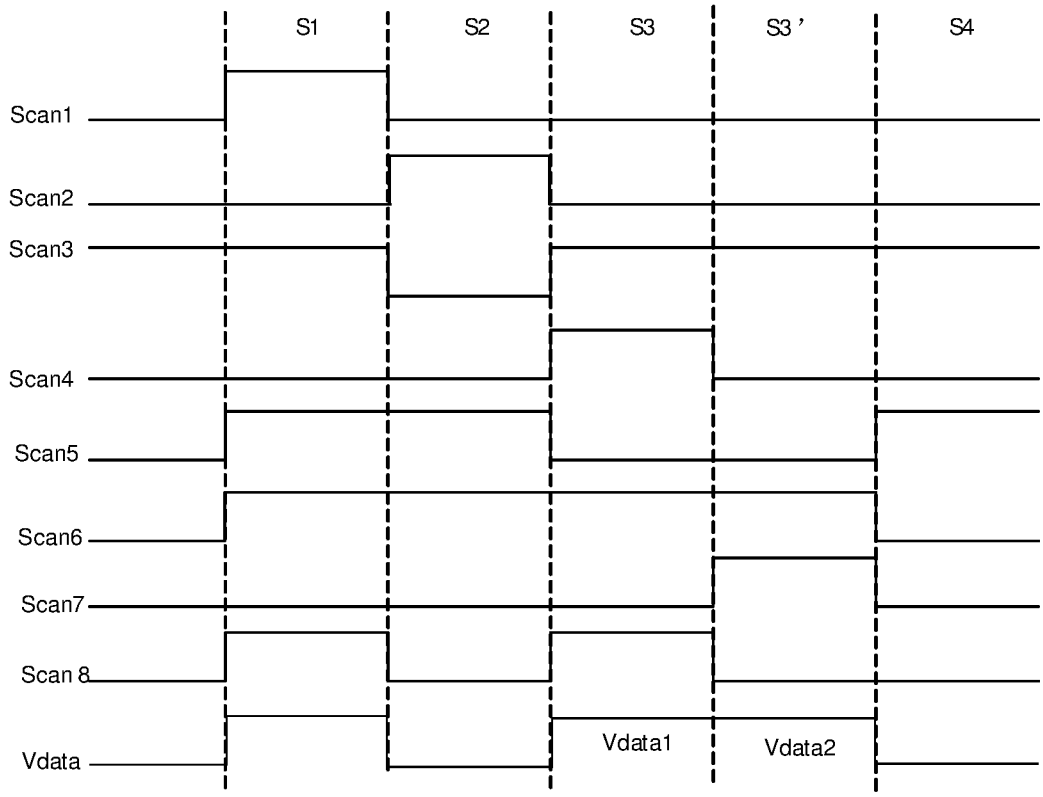
FIG. 6 shows a timing diagram of the pixel driving circuit according to an embodiment of the present disclosure.

In addition, before the fourth phase S4, the sixth scanning signal Scan6 maintains at a high level, so as to ensure the fourth node N4 being in an initial state before the light emitting phase S4, with reference to FIG. 6. Thus, it is possible to ensure a stable illumination of the organic light emitting diode during the light emitting phase S4.

Thereafter, during the light emitting phase S4, the third scanning signal Scan3 and the fifth scanning signal Scan5 are high level signals, and the organic light emitting diode OLED starts to emit light.

During the phase S4, the third scanning signal Scan3 and the fifth scanning signal Scan5 are high level signals. The fifth transistor T5 and the third transistor T3 are both turned on. The first capacitor C1 continues discharging the second node N2, that is, the gate of the driving transistor DTFT. The voltage at the second node N2 becomes the third voltage $V_3$, so as to control the current flowing through the source and drain of the driving transistor DTFT, thereby enable the organic light emitting diode OLED driven by the current to emit the light with a corresponding brightness.

In this case, if $V_{data1}=V_{data2}$, the driving current $I_{OLED}$ flowing through the organic light emitting diode OLED can be given by:

$$I_{OLED} = \frac{1}{2}\mu Cox\frac{W}{L}[2V_{data1} - V_{VDD}]^2.$$

It can be seen that the driving current $I_{OLED}$ flowing through the organic light emitting diode OLED is independent from the threshold voltage $V_{th}$ of the driving transistor DTFT. Certainly, in a case of $V_{data1}\neq V_{data2}$, the driving current $I_{OLED}$ is also independent from the threshold voltage $V_{th}$. Thus, it is possible to avoid the problem of uneven brightness of the display due to the drift of the threshold voltage of the driving transistor. Further, it is also possible to increase the driving current flowing through the organic light emitting diode OLED, thereby improving the brightness of the organic light emitting diode OLED. Certainly, in the case where the organic light emitting diode OLED emits light with the same brightness (with the same driving current $I_{oLED}$), the lower first data voltage $V_{data1}$ can be applied, thereby reducing the power consumption for driving.

Further, in the method for driving the pixel driving circuit discussed above, the value of the signal voltage input by the data signal terminal Data in the pre-charging phase S1 is not limited in the embodiments of the disclosure, as long as it is greater than the threshold voltage of the driving transistor. In order to simplify the control, the value may be set to be equal with the first data voltage $V_{data1}$ of the data signal terminal Data in the pixel data writing phase S3.

In addition, the turning-on and turning-off processes of the transistors in the above embodiments are all described by taking all of the transistors being N-type transistors as an example. When all of the transistors are P-type transistors, it is necessary to invert the respective controlling signals in FIG. 4 and FIG. 6.

Embodiments of the present disclosure also provide a display device including the pixel driving circuit in accordance with the embodiments of the present disclosure.

It should be noted that, in the embodiment of the present disclosure, the display device may at least include an organic light emitting diode display panel, and the display device may be any product or component that has a display function, such as, an OLED panel, an electronic paper, a mobile phone, a tablet, a television, a display, a laptop, a digital photo frame, a navigator and the like.

It should be understood that the above description is only a specific implementation of the embodiments of the present disclosure, and the scope of the present disclosure is not limited thereto. All changes or substitutions that are easily conceived by those skilled in the art in view of the embodiments of the present disclosure are intended to be included within the scope of the present disclosure. Therefore, the scope of the present disclosure should be defined by the claims.

We claim:

1. A pixel driving circuit configured to drive a light emitting element to emit light, the pixel driving circuit comprising:

a driving transistor, a drain of the driving transistor being electrically coupled to a first node, a gate of the driving transistor being electrically coupled to a second node, and a source of the driving transistor being electrically coupled to a first terminal of the light emitting element;

a first controlling circuit electrically coupled to the second node and a data signal terminal, and configured to receive a first scanning signal, and output a signal of the data signal terminal to the second node under a control of the first scanning signal;

a second controlling circuit electrically coupled to the first node and the second node, and configured to receive a second scanning signal, and control an electrical connection between the first node and the second node by the second scanning signal;

a third controlling circuit electrically coupled to a first voltage signal terminal and the first node, and configured to receive a third scanning signal, and control the electrical connection between the first voltage signal terminal and the first node by the third scanning signal;

a first energy storing circuit electrically coupled to the second node and a third node; and a first adjusting circuit electrically coupled to the third node, a fourth node, a second voltage signal terminal and the data signal terminal, and configured to receive a fourth scanning signal, output the signal form the data signal terminal to the third node under a control of the fourth scanning signal, receive a fifth scanning signal and a sixth scanning signal, and output a second voltage signal form the second voltage signal terminal to the third node and the fourth node under a control of the fifth scanning signal and sixth scanning signal respectively;

wherein the first adjusting circuit comprises:

a first adjusting sub-circuit electrically coupled to the third node and the data signal terminal, and configured to receive the fourth scanning signal, and output the signal of the data signal terminal to the third node, under the control of the fourth scanning signal;

a second adjusting sub-circuit electrically coupled to the third node and the fourth node, and configured to receive the fifth scanning signal, and control the electrical connection between the third node and the fourth node by the fifth scanning signal; and a third adjusting sub-circuit electrically coupled to the fourth node and the second voltage signal terminal, and configured to receive the sixth scanning signal, and control the electrical connection between the fourth node and the second voltage signal terminal by the sixth scanning signal.

2. The pixel driving circuit of claim 1, wherein:

the first controlling circuit comprises a first transistor, a gate of the first transistor being electrically coupled to receive the first scanning signal, a first electrode of the first transistor being electrically coupled to the data signal terminal, and the second electrode of the first transistor being electrically coupled to the second node;

the second controlling circuit comprises a second transistor, a gate of the second transistor being electrically coupled to receive the second scanning signal, a first electrode of the second transistor being electrically coupled to the second node, and a second electrode of the second transistor being electrically coupled to the first node;

the third controlling circuit comprises a third transistor, a gate of the third transistor being electrically coupled to receive the third scanning signal, a first electrode of the third transistor being electrically coupled to the first voltage signal terminal, and the second electrode of the third transistor being electrically coupled to the first node; and the first energy storing circuit comprises a first capacitor, a first terminal of the first capacitor being electrically coupled to the second node, and a second terminal of the first capacitor being electrically coupled to the third node.

3. The pixel driving circuit of claim 1, wherein:

the first controlling circuit comprises a first transistor, a gate of the first transistor being electrically coupled to receive the first scanning signal, a first electrode of the first transistor being electrically coupled to the data signal terminal, and the second electrode of the first transistor being electrically coupled to the second node;

the second controlling circuit comprises a second transistor, a gate of the second transistor being electrically coupled to receive the second scanning signal, a first electrode of the second transistor being electrically coupled to the second node, and a second electrode of the second transistor being electrically coupled to the first node;

the third controlling circuit comprises a third transistor, a gate of the third transistor being electrically coupled to receive the third scanning signal, a first electrode of the third transistor being electrically coupled to the first voltage signal terminal, and the second electrode of the third transistor being electrically coupled to the first node; and the first energy storing circuit comprises a first capacitor, a first terminal of the first capacitor being electrically coupled to the second node, and a second terminal of the first capacitor being electrically coupled to the third node.

4. The pixel driving circuit of claim 1, wherein:

the first adjusting sub-circuit comprises a fourth transistor, a gate of the fourth transistor being electrically coupled to receive the fourth scanning signal, a first electrode of the fourth transistor being electrically coupled to the data signal terminal, and a second electrode of the fourth transistor being electrically coupled to the third node;

the second adjusting sub-circuit comprises a fifth transistor, a gate of the fifth transistor being electrically coupled to receive the fifth scanning signal, a first electrode of the fifth transistor being electrically coupled to the third node, and a second electrode of the fifth transistor being electrically coupled to the fourth node; and the third adjusting sub-circuit comprises a sixth transistor, a gate of the sixth transistor being electrically coupled to receive the sixth scanning signal, a first electrode of the sixth transistor being electrically coupled to the fourth node, and the second electrode of the sixth transistor being electrically coupled to the second voltage signal terminal.

5. The pixel driving circuit of claim 1, further comprising:

a second energy storing circuit electrically coupled to the third node and a fifth node; and a second adjusting circuit electrically coupled to the data signal terminal, the fifth node and the second voltage signal terminal, and configured to receive a seventh scanning signal, output the signal of the data signal terminal to the fifth node under a control of the seventh scanning signal, receive an eighth scanning signal, and output the second voltage signal to the fifth node under a control of the eighth scanning signal.

6. The pixel driving circuit of claim 1, further comprising:

a second energy storing circuit electrically coupled to the third node and a fifth node; and a second adjusting circuit electrically coupled to the data signal terminal, the fifth node and the second voltage signal terminal, and configured to receive a seventh scanning signal, output the signal of the data signal terminal to the fifth node under a control of the seventh scanning signal, receive an eighth scanning signal, and output the second voltage signal to the fifth node under a control of the eighth scanning signal.

7. The pixel driving circuit of claim 5, wherein:

the second energy storing circuit comprises a second capacitor, a first terminal of the second capacitor being electrically coupled to the third node, and a second terminal of the second capacitor being electrically coupled to the fifth node; and the second adjusting circuit comprises a seventh transistor and an eighth transistor, a gate of the seventh transistor being electrically coupled to receive the seventh scanning signal, a first electrode of the seventh transistor being electrically coupled to the data signal terminal, and a second electrode of the seventh transistor being electrically coupled to the fifth node; and a gate of the eighth transistor being electrically coupled to receive the eighth scanning signal, a first electrode of the eighth transistor being electrically coupled to the fifth node, and a second electrode of the eighth transistor being electrically coupled to the second voltage signal terminal.

8. The pixel driving circuit of claim 6, wherein:

the second energy storing circuit comprises a second capacitor, a first terminal of the second capacitor being electrically coupled to the third node, and a second terminal of the second capacitor being electrically coupled to the fifth node; and the second adjusting circuit comprises a seventh transistor and an eighth transistor, a gate of the seventh transistor being electrically coupled to receive the seventh scanning signal, a first electrode of the seventh transistor being electrically coupled to the data signal terminal, and a second electrode of the seventh transistor being electrically coupled to the fifth node; and a gate of the eighth transistor being electrically coupled to receive the eighth scanning signal, a first electrode of the eighth transistor being electrically coupled to the fifth node, and a second electrode of the eighth transistor being electrically coupled to the second voltage signal terminal.

9. A method of driving the pixel driving circuit of claim 1, comprising:

during a first phase, writing the signal of the data signal terminal to the first energy storing circuit under the control of the first scanning signal, and outputting the second voltage signal to the third node and the fourth node for resetting, under the control of the fifth scanning signal and the sixth scanning signal;

during a second phase, discharging, by the first energy storing circuit, the second node, under the control of the second scanning signal, the fifth scanning signal and the sixth scanning signal, so as to enable the second node being at a first voltage;

during a third phase, outputting the signal of the data signal terminal at the first voltage to the third node under the control of the third scanning signal and the fourth scanning signal, and adjusting, by the first energy storing circuit, a voltage at the second node from the first voltage to a second voltage; and during a fourth phase, driving, by the driving transistor, the light emitting element to emit light under the control of the third scanning signal and the fifth scanning signal.

10. The method of claim 9, wherein the pixel driving circuit further comprises: a second energy storing circuit electrically coupled to the third node and a fifth node; and a second adjusting circuit electrically coupled to the fifth node and the second voltage signal terminal, and configured to receive the seventh scanning signal and a data signal, and output the data signal to the fifth node under a control of the seventh scanning signal, and the method further comprises:

during a fifth phase which is after the third phase but before the fourth phase, outputting the signal of the data signal terminal at the second voltage to the fifth node under the control of the seventh scanning signal, and adjusting the voltage at the second node from the second voltage to a third voltage by the first energy storing circuit and the second energy storing circuit.

11. The method of claim 9, wherein the pixel driving circuit further comprises: a second energy storing circuit electrically coupled to the third node and a fifth node; and a second adjusting circuit electrically coupled to the fifth node and the second voltage signal terminal, and configured to receive the seventh scanning signal and a data signal, and output the data signal to the fifth node under a control of the seventh scanning signal, and the method further comprises:

during the first phase, outputting the second voltage signal to the fifth node for resetting, under the control of the eighth scanning signal.

12. The method of claim 9, wherein the pixel driving circuit further comprises: a second energy storing circuit electrically coupled to the third node and a fifth node; and a second adjusting circuit electrically coupled to the fifth node and the second voltage signal terminal, and configured to receive the seventh scanning signal and a data signal, and output the data signal to the fifth node under a control of the seventh scanning signal, and the method further comprises:

during the third phase, outputting the second voltage signal to the fifth node for resetting, under the control of the eighth scanning signal.

13. The method of claim 9, wherein during the first phase, the second phase and the third phase, the second voltage signal from the second voltage signal terminal is outputted to the fourth node under the control of the sixth scanning signal.

14. A display device comprising the pixel driving circuit of claim 1.

* * * * *